US007678519B2

(12) United States Patent
Iwanaga et al.

(10) Patent No.: US 7,678,519 B2
(45) Date of Patent: Mar. 16, 2010

(54) ELECTROPHOTOGRAPHIC PHOTORECEPTOR, PROCESS CARTRIDGE, AND IMAGE FORMING APPARATUS

(75) Inventors: Takeshi Iwanaga, Kanagawa (JP); Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 27 days.

(21) Appl. No.: 12/051,497

(22) Filed: Mar. 19, 2008

(65) Prior Publication Data

US 2008/0254379 A1 Oct. 16, 2008

(30) Foreign Application Priority Data

Apr. 16, 2007 (JP) ..... 2007-107077

(51) Int. Cl.
*G03G 15/04* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS 4,737,429 A * 4/1988 Mort et al. ..... 430/57.5
2002/0051918 A1* 5/2002 Miyamoto et al. ..... 430/58.65

FOREIGN PATENT DOCUMENTS

| | | |
|---|---|---|
| JP | A 58-80647 | 5/1983 |
| JP | A 9-101625 | 4/1997 |
| JP | A 2003-27238 | 1/2003 |
| JP | A 2006-267507 | 10/2006 |

* cited by examiner

*Primary Examiner*—Mark A Chapman
(74) *Attorney, Agent, or Firm*—Oliff & Berridge, PLC

(57) ABSTRACT

The present invention provides an electrophotographic photoreceptor, a process cartridge and an image forming apparatus including the same, wherein the electrophotographic photoreceptor prevents the generation of excessive residual potential, which usually occurs on a photoreceptor having a protective layer composed of an inorganic material, and achieves both of high durability and favorable electrical characteristics.

An electrophotographic photoreceptor composed of a conductive substrate having thereon a photosensitive layer and a surface layer formed in this order, wherein the total composition ratio of a group 13 element, oxygen, and hydrogen to the total element content in the surface layer is 0.95 or more, and the abundance ratio of the oxygen to the group 13 element is from 1.1 to 1.5.

14 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-107077 filed Apr. 16, 2007.

TECHNICAL FIELD

The invention relates to an electrophotographic photoreceptor, a process cartridge, and an image forming apparatus.

RELATED ART

Recently, an electrophotography method has been extensively applied to an image forming apparatus, such as a photocopier or a printer. Since an electrophotographic photoreceptor (hereinafter, occasionally referred to as 'photoreceptor') that is used in the image forming apparatus using the electrophotography method is exposed to various types of contacts or stresses in the apparatus, deterioration may occur. Meanwhile, high reliability is required for digital and color applications of the image forming apparatus.

For example, a charging process of photoreceptors has the following problem. When a photoreceptor is charged under a non-contact charging system, discharge products adhere to the photoreceptor, causing image blurring or other problems. Discharge products attached to the photoreceptor are removed by, for example, a developer which contains polishing particles and is scraped off with a cleaning unit. However, in this case, the photoreceptor surface may be deteriorated by abrasion.

In recent years, contact charging systems have been widely used, however abrasion of a photoreceptor may be accelerated also under these systems.

Thus, it is desirable for electrophotographic photoreceptors to have a longer life. In order to increase the life of an electrophotographic photoreceptor, the photoreceptor must have higher abrasion resistance, so it is required to have a harder surface. Although a photoreceptor composed of amorphous silicon has a hard surface, discharge products tend to adhere to the surface to cause image blurring or image bleeding, phenomena which are particularly significant at high humidities.

In recent years, organic photoreceptors have been widely used as image holding members of an electrographic image forming apparatus by virtue of their low cost. However, an organic photoreceptor has a shorter life than an inorganic photoreceptor because it is worn by friction with the cleaning blade in contact with the surface of the photoreceptor.

In order to solve the above-described problems, it has been attempted to form a surface protective layer at the surface of a photoreceptor using a hard film made of diamond like carbon (DLC), amorphous carbon nitride (CN), or amorphous silicon nitride. In this way, carbon-based materials are frequently used as the surface layer of photoreceptors to prevent the occurrence of the above-described problems.

As one of the materials composing the protective layer of the photoreceptor, the inventors have suggested a material containing a group 13 element and oxygen. An electrophotographic photoreceptor having a protective layer composed of these materials is not easily worn down by repeated use, and maintains high water repellency during repeated use as an electrophotographic photoreceptor over a long period. Therefore, the electrophotographic photoreceptor prevents the occurrence of problems such as deterioration of image quality caused by adhesion of discharge products.

In the above-described techniques, the thickness of the protective layer (surface layer) is preferably larger from the viewpoint of improving mechanical strength and durability such as scratch resistance. In particular, if an organic photoreceptor is arranged below a protective layer having an insufficient thickness, the protective layer may be significantly deformed due to the soft underlayer, which results in cracks or other defects on the protective layer. Accordingly, it is effective to increase the thickness of the layer.

On the other hand, in cases where the protective layer is insulative, increasing the thickness of the protective layer may adversely affect the electrical characteristics. More specifically, charges generated upon exposure of a photosensitive layer do not transmit through the insulative protective layer, and accumulate at the interface between the protective layer and the photosensitive layer, and do not recombine with the charges on the surface. The charges remaining on the surface and the interface between the protective layer and the photosensitive layer become a residual potential. The residual potential increases with the increase of the thickness of the protective layer, which may cause problems such as a decrease in printed image density following repeated use.

In order to prevent such problems, the protective layer of the surface preferably has electrical conductivity. However, if the surface protective layer has excessive electrical conductivity, the electrostatic latent image may bleed in the in-plane direction. In particular, in cases where the protective layer is composed of the above-described oxide material, it is difficult to achieve appropriate electrical conductivity, and problems such as the bleeding of the electrostatic latent image in the in-plane direction may occur.

As described above, a photoreceptor having a surface layer composed of an inorganic material must have a large thickness to achieve mechanical durability. However, under present circumstances, it is difficult to prevent the increase of the residual potential without deterioration of the image quality.

SUMMARY

According to an aspect of the invention, there is provided an electrophotographic photoreceptor comprising a conductive substrate having thereon a photosensitive layer and a surface layer formed in this order, wherein the total composition ratio of a group 13 element, oxygen, and hydrogen to the total element content in the surface layer is 0.95 or about 0.95 or more, and the abundance ratio of the oxygen to the group 13 element is from 1.1 or about 1.1 to 1.5 or about 1.5.

BRIEF DESCRIPTION OF THE DRAWINGS

Exemplary embodiment(s) of the present invention will be described in detail based on the following figures, wherein.

DETAILED DESCRIPTION

Figure 1:
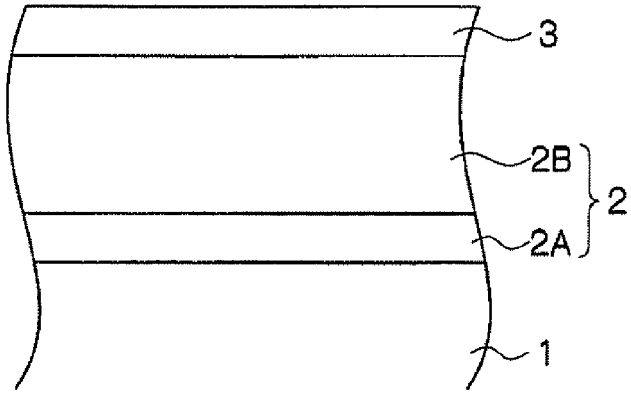
FIG. 1 is a schematic cross sectional view showing an example of the layer structure of the photoreceptor of the present invention

Exemplary embodiments of the invention are described in detail hereinafter.

The above-described problems are solved by the invention as described below.

More specifically, the invention in accordance with a first aspect of the invention is an electrophotographic photoreceptor composed of a conductive substrate having thereon a photosensitive layer and a surface layer formed in this order, wherein the total composition ratio of a group 13 element, oxygen, and hydrogen to the total element content in the surface layer is 0.95 or about 0.95 or more, and the abundance ratio of the oxygen to the group 13 element is from 1.1 or about 1.1 to 1.5 or about 1.5.

The invention in accordance with a second aspect is the electrophotographic photoreceptor of the first aspect, wherein the abundance ratio of the oxygen to the group 13 element is from 1.1 or about 1.1 to 1.4 or about 1.4.

The invention in accordance with a third aspect is the electrophotographic photoreceptor of the first or second aspect, wherein the surface layer has a film thickness of from 0.2 μm or about 0.2 μm to 2.0 μm or about 2.0 μm.

The invention in accordance with a fourth aspect is the electrophotographic photoreceptor of any one of the first to third aspects, wherein the surface layer is formed by plasma CVD.

The invention in accordance with a fifth aspect is the electrophotographic photoreceptor of any one of the first to fourth aspects, wherein the photosensitive layer is an organic photosensitive layer.

The invention in accordance with a sixth aspect is a process cartridge composed of an electrophotographic photoreceptor, and at least one selected from a charging unit for charging the surface of the electrophotographic photoreceptor, a developing unit for developing the electrostatic latent image formed on the surface of the electrophotographic photoreceptor with at least a developer containing a toner thereby forming a toner image, and a transferring unit for transferring the toner image to a recording medium, wherein the electrophotographic photoreceptor is the electrophotographic photoreceptor of any one of the first to fifth aspects, and the electrophotographic photoreceptor is removable from the main body of the image forming apparatus.

The invention in accordance with a seventh aspect is an image forming apparatus composed of an electrophotographic photoreceptor, a charging unit for charging the surface of the electrophotographic photoreceptor, an exposure unit for exposing the surface of the electrophotographic photoreceptor charged by the charging unit thereby forming an electrostatic latent image, a developing unit for developing the electrostatic latent image with a developer containing at least a toner thereby forming a toner image, and a transferring unit for transferring the toner image to a recording medium, wherein the electrophotographic photoreceptor is the electrophotographic photoreceptor of any one of the first to fifth aspects.

<Electrophotographic Photoreceptor>

The electrophotographic photoreceptor of the invention is composed of a conductive substrate having thereon a photosensitive layer and a surface layer formed in this order, wherein the total composition ratio of the group 13 element, oxygen, and hydrogen to the total element content in the surface layer is 0.95 or about 0.95 or more, and the abundance ratio of the oxygen to the group 13 element is from 1.1 or about 1.1 to 1.5 or about 1.5.

When the surface layer composed of an inorganic material as described above is provided as a protective layer on a photoreceptor, the residual potential of the photoreceptor may increase. The increase of the residual potential is more significant when the inorganic thin film has a large thickness. In some cases, the residual potential may be 100 V or more.

The electrical conductivity may be increased by changing the composition of the elements composing the surface layer. For example, an outermost surface layer of oxidized (or naturally oxidized) gallium nitride film is stoichiometric gallium oxide and is insulative, however it is known that oxides composed of oxygen and a metal element in nonstoichiometric ratio, for example, indium oxide, gallium oxide, zinc oxide, and lead oxide, develop electrical conductivity because conduction electrons are generated by the oxygen deficiency in the structure.

However, the electrical resistance of the oxides is significantly decreased by slightly changing the abundance ratio between oxygen and the metal element, which makes it difficult to delicately adjust the resistance value to prevent the occurrence of image defects such as the bleeding of the electrostatic latent image in the in-plane direction.

As a result of the study by the inventors, it is found that the adjustable range of the electrical resistance is broadened and both of the increase of the residual potential and the occurrence of image defects are prevented when, for example, the gallium oxide contains hydrogen, and the abundance ratio of oxygen to gallium is within a specified range.

More specifically, it has been found that both of the electrical characteristics and the image characteristics are effectively achieved when the total composition ratio of the group 13 element, oxygen, and hydrogen with reference to the surface layer containing the group 13 element, oxygen, and hydrogen is about 0.95 or more, and the abundance ratio of the oxygen to the group 13 element is from about 1.1 to about 1.5.

In the gallium oxide film containing hydrogen, hydrogen is considered to combine with gallium thereby electrically inactivating electrons of gallium deficient in oxygen to influence the electrical characteristics. In addition, hydrogen contained in the film is considered to increase flexibility of the bonds. The relationship between the composition and electrical characteristics of the gallium oxide containing hydrogen is considered to be different from that of gallium oxide containing no hydrogen. However, it is not evident why the controllability of the electrical resistance is improved by the above-described composition (structure).

If the total composition ratio of the elements is less than about 0.95, for example, a group 15 element such as N, P, or As may combine with gallium to give unignorable influences. In this case, the appropriate range of the abundance ratio of oxygen to the group 13 element which achieves both of the electrical characteristics and the image characteristics defined in the invention cannot be established.

The total composition ratio of the 13 element, oxygen, and hydrogen is preferably 0.99 or about 0.99 or more.

If the abundance ratio of oxygen to the group 13 element is less than about 1.1, the electrical resistivity of the film is so low that the electrostatic latent image bleeds in the in-plane direction, which results in the failure of achieving the intended image resolution. If the abundance ratio is more than about 1.5, the material composed of the group 13 element, oxygen, and hydrogen becomes unstable.

The abundance ratio of oxygen to the group 13 is desirably from 1.1 or about 1.1 to 1.4 or about 1.4, more preferably from 1.1 or about 1.1 to 1.3 or about 1.3. If the abundance ratio is more than about 1.4, the film has insufficient electrical conductivity, and the increase of the film thickness may produce a problem of excessive residual potential.

The elemental composition in the invention refers to the value averaged in the film thickness direction of the outermost surface excluding the range from the surface layer to a depth of 10 nm. The range from the outermost surface to a depth of 10 nm is excluded to eliminate the influence of contamination by carbon and others, and the influence of natural oxidation. Even if a stoichiometric insulating film is formed by the natural oxidation in the range from the surface to a depth of 10 nm or less, the electrical characteristics of the photoreceptor are hardly affected. The elemental composition may be inclined toward the film thickness direction, wherein the value is averaged in the film thickness direction.

Hereunder is a description of the structure of the electrophotographic photoreceptor of an exemplary embodiment of the present invention.

FIG. 1 is a schematic cross-section showing an example of a layer structure of a photoreceptor of an exemplary embodiment of the present invention, wherein 1 denotes a conductive substrate, 2 denotes a photosensitive layer, 2A denotes a charge generation layer, 2B denotes a charge transport layer, and 3 denotes a surface layer.

The photoreceptor shown in FIG. 1 has a layer structure where on the conductive substrate 1 is formed with the charge generation layer 2A, the charge transport layer 2B, and the surface layer 3 in this order. The photosensitive layer 2 includes two layers of the charge generation layer 2A and the charge transport layer 2B.

Figure 2:
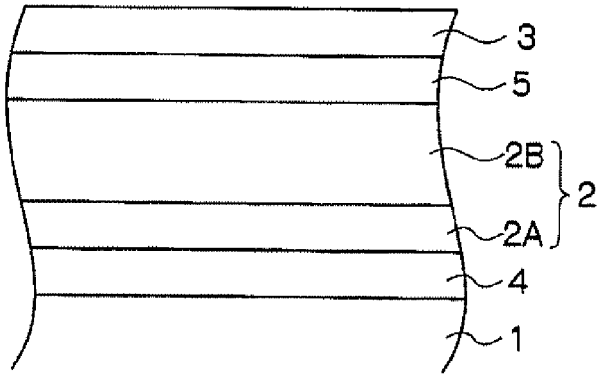
FIG. 2 is a schematic cross sectional view showing another example of the layer structure of the photoreceptor of the invention.

FIG. 2 is a schematic cross-section showing another example of a layer structure of the photoreceptor of an exemplary embodiment of the present invention, wherein 4 denotes an under coating layer, 5 denotes an intermediate layer, and the others are the same as shown in FIG. 1. The photoreceptor shown in FIG. 2 has a layer structure where on the conductive substrate 1 is formed with the under coating layer 4, the charge generation layer 2A, the charge transport layer 2B, the intermediate layer 5, and the surface layer 3 in this order.

Figure 3:
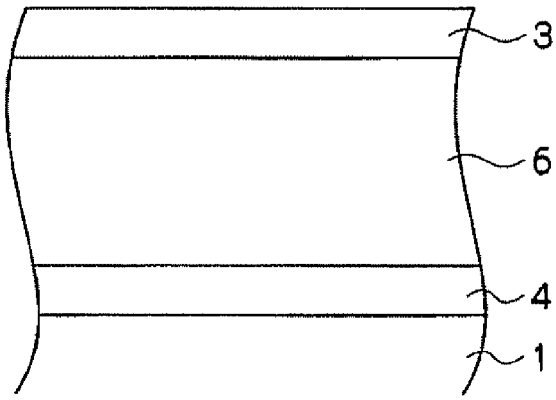
FIG. 3 is a schematic cross sectional view showing another example of the layer structure of the photoreceptor of the invention.

FIG. 3 is a schematic cross-section showing another example of a layer structure of a photoreceptor of an exemplary embodiment of the present invention, wherein 6 denotes the photosensitive layer and the others are the same as shown in FIG. 1 and FIG. 2.

The photoreceptor shown in FIG. 3 has a layer structure where on the conductive substrate 1 is formed with the photosensitive layer 6 and the surface layer 3 in this order. The photosensitive layer 6 is a layer having integrated functions of a charge generation layer 2A and the charge transport layer 2B shown in FIG. 1 and FIG. 2.

In the exemplary embodiment of the invention, the photosensitive layers 2 and 6 may be composed of an organic material or an inorganic material.

Specifically, the group 13 element contained in the surface layer 3 may be at least one selected from Al, Ga and In. Two or more elements may be contained in the surface layer.

The content of hydrogen contained in the surface layer 3 is preferably from 1 atom % to 30 atom %, more preferably from 5 atom % to 20 atom %. If the content of hydrogen is less than 1 atom %, the surface layer 3 may have insufficient effect of electrically inactivating electrons of the group 13 element deficient in oxygen. If the content is more than 30 atom %, the probability that two or more hydrogen atoms combine with the group 13 element and a nitrogen atom increases, so that the three-dimensional structure may be collapsed to offer insufficient hardness and chemical stability, in particular water resistance.

The surface layer 3 in the exemplary embodiment of the invention is, as described above, composed mainly of oxygen, the group 13 element, and hydrogen, and may contain other elements as impurities. However, excessive impurities may affect the electrical characteristics, so that the amount of impurities is preferably smaller. Specifically, the amount of impurities is 5 atom % or less, preferably 1 atom % or less. In particular, in cases where nitrogen atoms are contained, the content of the nitrogen atoms is desirably 1 atom % or less.

The content of elements such as group 13 elements and oxygen in the surface layer 3 of an exemplary embodiment of the invention as well as the distribution in the direction of thickness can be determined as follows by Rutherford back scattering (may be referred to "RBS" hereinafter).

An accelerator (trade name: 3SDH PELLETRON, manufactured by NEC corporation), an end station (trade name: RBS-400, manufactured by CE & A Co., Ltd.), and a system (trade name: 3S-R10) are used for RES. The data is analyzed using HYPRA program (trade name, manufactured by CE & A Co., Ltd.).

The measuring condition of RBS is He++ ion beam energy of 2.275 eV, detection angle of 160°, grazing angle with respect to incident beam of about 109°.

The RBS measurement is specifically carried out as follows.

In the RBS measurement, the $He^{++}$ ion beam is incident orthogonally to the sample, and the detector is set at 160° with respect to the ion beam, so as to measure signals of He backscattered. From the detected energy and intensity of He, the composition ratio and the film thickness are determined. In order to improve the accuracy of obtaining the composition ratio and the film thickness, the spectrum may be measured with two detection angles. The accuracy can be improved by measuring and cross checking with two different detection angles having different resolutions in the depth direction and different backscattering dynamics.

The number of He atoms backscattered by target atoms is determined by three factors of; 1) atomic number of the target atom, 2) energy of the He atoms before scattering, and 3) scattering angle. The density is assumed by calculation from the measured composition, and the film thickness is calculated using this. The error of the density is within 20%.

Moreover, the hydrogen content can be calculated by Hydrogen Forward Scattering (hereinafter, may be referred to as HFS) as shown below.

For the HFS, an accelerator (trade name: 3SDH PELLETRON, manufactured by NEC), and an endstation (trade name: RBS-400, manufactured by CE&A Co., Ltd.) are used, and a 3S-R10 is used as the system. The HYPRA program of CE & A Co., Ltd. is used for analysis. The measurement conditions of the HFS are as follows.

$He^{++}$ Ion Beam Energy: 2.275 eV

Detection Angle 160°

Grazing Angle with respect to incident beam 30°

In the HFS measurement, by setting the detector at 30° with respect to the $He^{++}$ ion beam, and the sample at 75° with respect to the normal line, signals of hydrogen scattered in front of the sample can be taken. At this time, preferably the detector is covered with a thin aluminum foil to remove He atoms scattered together with hydrogen. The amount is measured by comparing the hydrogen counts of the reference sample and the target sample after standardization by the stopping power As the reference sample, an H ion injected Si sample and muscovite were used. The muscovite is known to have a hydrogen concentration of about 6.5 atomic %. H adsorbed in the most outer surface can be measured by subtracting the H amount adsorbed on a clean Si surface. Other examples include, however not limited to, secondary ion mass spectrometry (SIMS), X ray photoelectron spectroscopy (XPS), Auger electron spectroscopy (AES), X-ray fluorescence elemental analysis (EDS), energy dispersive X-ray fluorescence analysis (EDX), and electron probe microanalyzer (EPMA), and electron energy loss spectroscopy (EELS). They may be used alone or in combination of two or more of them.

The elemental composition data in the depth direction may be measured by, for example, a method of profiling the depth from the surface, a method of measuring the surface with the surface being etched by sputtering in a vacuum, or a method of mapping the composition of a sectional sample. The method may be selected in accordance with the analysis method. Under any method, the elemental composition in the invention is determined not on the outermost surface of the surface layer alone but the whole layer excluding the range from the outermost surface to a depth of 10 nm.

The thickness of the surface layer 3 in accordance with the exemplary embodiment of the invention is desirably from 0.2 μm or about 0.2 μm to 2.0 μm or about 2.0 μm. If the thickness is less than about 0.2 μm, the layer has insufficient mechanical strength, which may be result in damages on the photoreceptor during traveling. For example, stoichiometric gallium oxide is usually transparent in the visible region. However, the material in accordance with the exemplary embodiment of the invention, in which the composition ratio of oxygen to gallium is from 1.1 or about 1.1 to 1.5 or about 1.5, absorbs light in the visible region, so that if the thickness is more than about 2.0 μm, the amount of exposure of the photosensitive layer during formation of the electrostatic latent image may be insufficient.

The thickness of the surface layer 3 is more preferably from 0.2 μm or about 0.2 μm to 1.0 μm or about 1.0 μm.

Each layer of the photoreceptor of an exemplary embodiment of the present invention will be described in more detail along with the method for manufacturing the same.

The layer structure of the photoreceptor of an exemplary embodiment of the present invention includes a photosensitive layer and a surface layer formed on a conductive substrate in this order. The photosensitive layer of an exemplary embodiment of the present invention may be constructed with organic substances or inorganic substances. An under-coating layer such as an intermediate layer may be provided between these layers, if necessary. The photosensitive layer may include plural layers as described above, and each layer may have a different function (function separation type).

In a case in which the photosensitive layer is constructed with organic materials, The organic polymer compound included in the photosensitive layer may be thermoplastic or thermosetting, or it may be formed by reacting two types of molecules. Moreover, between the photosensitive layer and the surface layer may be provided an intermediate layer from the viewpoints of adjusting the hardness, the coefficient of expansion, and the elasticity, improving the adhesiveness, and the like. The intermediate layer may show intermediate characteristics with respect to both of the physical characteristics of the surface layer and the physical characteristics of the photosensitive layer (charge transport layer in the case of the function separation type). Moreover, if the intermediate layer is provided, the intermediate layer may act as a layer which traps charges.

The photosensitive layer may be a function separation type photosensitive layer 2 having the charge generation layer 2A and the charge transport layer 2B separately as shown in FIG. 1, or may be a function integration type photosensitive layer 6 as shown in FIG. 2. In the case of the function separation type, the surface side of the photoreceptor may be provided with the charge generation layer, or the surface side may be provided with the charge transport layer. A photosensitive layer will be described below focusing on the function separation type photosensitive layer 2.

If a surface layer 3 is formed on the photosensitive layer by a method described later, in order to prevent decomposition of the photosensitive layer 2 due to the irradiation of electromagnetic radiation of shorter wavelengths other than heat, the photosensitive layer surface may be previously provided with a short-wavelength light absorber layer against ultraviolet light or the like, prior to formation of the surface layer 3.

Moreover, the layer containing an ultraviolet absorber (for example, a layer formed by application or the like of a layer dispersed in a polymeric resin) may be provided on the photosensitive layer surface.

In this manner, prior to formation of the surface layer 3, the photoreceptor surface is provided with the intermediate layer, and thereby effects on the photosensitive layer by short-wavelength light such as ultraviolet light when forming the surface layer 3, corona discharge if the photoreceptor is used in the image forming apparatus, or ultraviolet light from other various light sources may be prevented.

While the surface layer 3 may be either amorphous or crystalline, it is preferable that the upper layer of the surface layer 3 is also amorphous for improving slidability of the surface of the photoreceptor.

(Formation of the Surface Layer)

The method for forming the surface layer 3 will be described below. The surface layer 3 may be formed directly on the photosensitive layer so that the group 13 element and nitrogen are contained. The surface of the photosensitive layer 2 may be cleaned with plasma. The surface layer may be formed by a generally known method for forming a thin film. In cases where a surface layer is formed on an organic photosensitive layer, the temperature of the organic photoreceptor as the substrate to be coated is preferably about 150° C. or less. In particular, plasma CVD is preferable from the viewpoints of, for example, forming an inorganic thin film in accordance with the exemplary embodiment of the invention with good adhesiveness on a substrate such as amorphous silicon or an organic photosensitive layer, forming an inorganic thin film having a composition range in accordance with the exemplary embodiment of the invention with good controllability according to the supply of the raw materials, and capable of forming a film at low temperatures. Other examples include, but not limited to, catalytic CVD, vacuum deposition, sputtering, ion plating, and molecular beam epitaxial growth.

Figure 4:
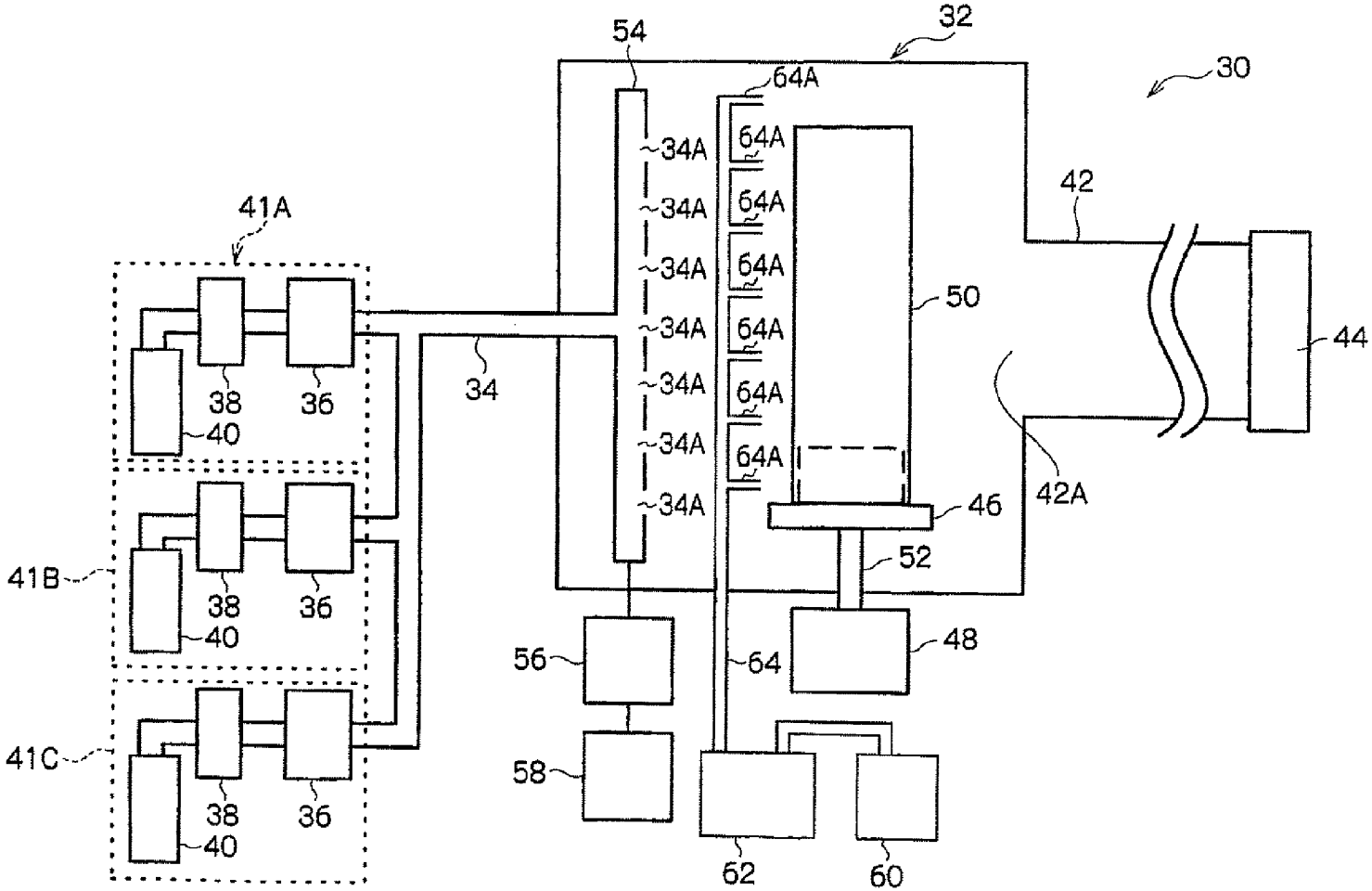
FIG. 4 is a schematic view showing an example of the film forming apparatus used in the invention.

FIG. 4 schematically illustrates the film forming apparatus that is used for forming the surface layer for the photoreceptor according to an exemplary embodiment of the present invention.

A film forming apparatus 30 includes a vacuum chamber 32 for vacuum exhaustion.

In the vacuum chamber 32, a support member 46 is provided to rotatably support an electrophotographic photoreceptor 50 which is not subjected to forming the protective layer (hereinafter, referred to as 'non-coated photoreceptor')

so that a longitudinal axis of the non-coated photoreceptor 50 is identical to a rotation axis. The support member 46 is connected through a support shaft 52 for supporting the support member 46 to a motor 48, and a driving force of the motor 48 is capable of being transferred through the support shaft 52 to the support member 46.

After the non-coated photoreceptor 50 is supported by the support member 46, the motor 48 is driven to transfer the driving force of the motor 48 through the support shaft 52 and the support member 46 to the non-coated photoreceptor 50, thus rotating the non-coated photoreceptor 50 while the longitudinal axis is identical to the rotation axis.

An exhaust pipe 42 is formed at an end of the vacuum chamber 32 to exhaust gas from the vacuum chamber 32. The exhaust pipe 42 communicates with the vacuum chamber 32 through an opening 42A of the vacuum chamber 32 at an end thereof, and is connected to a vacuum exhaust unit 44 at another end thereof. The vacuum exhaust unit 44 includes one or a plurality of vacuum pumps. However, the vacuum exhaust unit may include a unit for controlling an exhaust rate, such as a conductance valve, if necessary.

When the vacuum exhaust unit 44 is driven so as to discharge air from the vacuum chamber 32 through the exhaust pipe 42, the inside of the vacuum chamber 32 is decompressed to a predetermined pressure (ultimate vacuum). The ultimate vacuum is preferably 1 Pa or less, more preferably 0.1 Pa or less. In the invention, as described later, the abundance ratio between oxygen and the group 13 element is controlled by the ratio of the feed rate of the gallium source and oxygen. If the ultimate vacuum is high, the amount of oxygen in the reaction atmosphere is greater than the supply because of the influence of oxygen and water remaining in the air, which results in poor controllability over the composition.

A discharge electrode 54 is provided in the vicinity of the non-coated photoreceptor 50 disposed in the vacuum chamber 32. The discharge electrode 54 is electrically connected to a high frequency electric source 58 via the matching box 56. The high frequency electric source 58 may be a DC or AC power supply, and preferably a high frequency AC power supply from the viewpoint of efficiently exciting gases.

The discharge electrode 54 has a plate shape, and is provided so that a longitudinal-axis direction of the discharge electrode 54 is identical to a rotation-axis direction (longitudinal-axis direction) of the non-coated photoreceptor 50. The discharge electrode 54 is spaced from an external circumferential surface of the non-coated photoreceptor 50. The discharge electrode 54 has a hollow structure (cave shape), and one or a plurality of openings 34A in a discharge side thereof to feed gas for generating plasma. If the discharge electrode 54 does not have the cave shape and the openings 34A on the discharge side thereof, the gas for generating the plasma is fed through a gas inlet that is separately formed, and flows between the non-coated photoreceptor 50 and the discharge electrode 54. Additionally, in order to prevent the occurrence of discharge between the discharge electrode 54 and the vacuum chamber 32, it is preferable that an earthed member cover an electrode side other than a side facing the non-coated photoreceptor 50 while a clearance of about 3 mm or less is left.

If high frequency power is supplied from the high frequency electric source 58 through the matching box 56 to the discharge electrode 54, the discharge is caused by the discharge electrode 54.

A gas feeding pipe 34 is formed in a region that faces the non-coated photoreceptor 50 so that the discharge electrode 54 is provided between the region and the untreated photoreceptor in the vacuum chamber 32, thus feeding gas through the hollow discharge electrode 54 to the non-coated photoreceptor 50 in the vacuum chamber 32.

The gas feeding pipe 34 communicates with the discharge electrode 54 at an end thereof (that is, the gas feeding pipe communicates with the vacuum chamber 32 through the discharge electrode 54 and the openings 34A), and is connected to a gas feeder 41A, a gas feeder 41B, and a gas feeder 41C at another end thereof.

The gas feeder 41A, the gas feeder 41B, and the gas feeder 41C each include an MFC (mass flow controller) 36 for controlling a feed rate of the gas, a pressure controller 38, and a gas feeding source 40. The gas feeding sources 40 of the gas feeder 41A, the gas feeder 41B, and the gas feeder 41C are connected through the pressure controllers 38 and the MFCs 36 to another end of the gas feeding pipe 34.

While a feeding pressure of the gas is controlled by the pressure controller 38 and the feeding rate of the gas is controlled by the MFC 36, the gas is fed from the gas feeding source 40 through the gas feeding pipe 34, the discharge electrode 54, and the openings 34A to the non-coated photoreceptor 50 of the vacuum chamber 32.

Additionally, the types of gases that are charged in the gas feeding sources 40 provided in the gas feeder 41A, the gas feeder 41B, and the gas feeder 41C may be the same. However, in the case of when treatment is performed using a plurality of types of gases, the gas feeding sources 40 where different types of gases are charged may be used. In this case, different types of gases are fed from the gas feeding sources 40 of the gas feeder 41A, the gas feeder 41B, and the gas feeder 41C to the gas feeding pipe 34 to form a mixture gas, and the mixture gas is fed through the discharge electrode 54 and the openings 34A to the non-coated photoreceptor 50 in the vacuum chamber 32.

Further, raw material gas containing a group 13 element is also supplied to the non-coated photoreceptor 50 in the vacuum chamber 32. The raw material gas is introduced from a raw material gas feeding source 62 into the vacuum chamber 32 via a gas introduction pipe 64 whose tip is a shower nozzle 64A.

When the group 13 element is gallium, the feed gas may be a gallium-containing gas compound such as trimethylgallium or triethylgallium, or metallic gallium. The oxygen source may be $O_2$ or an oxygen-containing substance.

In the example shown in FIG. 4 described is a case where the discharge system by the discharge electrode 54 is capacitance type. The discharge system, however, may alternatively be inductance type.

The film formation may be conducted, for example, as follows. The inside of the vacuum chamber 32 is decompressed by the vacuum exhaust unit 44 to a predetermined pressure. In this state, high frequency electric power is supplied from the high frequency electric source 58 to the discharge electrode 54 via the matching box 56, and a plasma-generating gas is introduced into the vacuum chamber 32 through the gas feeding pipe 34. At this time, plasma is generated on the discharge side of the discharge electrode 54 and is radiated therefrom to the opening 42A of the exhaust pipe 42.

The pressure in the vacuum chamber 32 during the plasma generation is preferably from 1 Pa to 500 Pa.

In the exemplary embodiment of the invention, the plasma-generating gas contains oxygen. The gas may be a mixed gas further containing inert gas such as He or Ar, and a non-film-forming gas such as $H_2$. The non-film-forming gas and inert gas may be used to control the pressure and other characteristics of the reaction atmosphere in the reaction vessel. In particular, hydrogen is important for the reaction at low temperatures as described later.

Next, by introducing gaseous trimethylgallium (organometallic compound containing a group 13 element) having been diluted with hydrogen using hydrogen as a carrier gas, into the vacuum chamber 32 via a gas introduction pipe 64 and a shower nozzle 64A while causing hydrogen from a gas feeding source 60 to pass through a raw material gas feeding source 62, it is possible to cause activated oxygen and trimethylgallium to react in an atmosphere containing active hydrogen, and thereby forming a film containing hydrogen, oxygen and gallium in the surface of the non-coated photoreceptor 50.

In this exemplary embodiment, it is desirable to form a film with a compound of a group 13 element and oxygen containing hydrogen on the non-coated photoreceptor 50 by introducing $O_2$ gas and $H_2$ gas as a mixture into the discharge electrode 54 and simultaneously producing active species, thereby decomposing trimethylgallium gas.

When hydrogen gas and oxygen gas are simultaneously activated in the plasma, and reacted with an organic metal compound containing the group 13 element, active hydrogen generated by plasma discharge may etch the hydrocarbon group such as a methyl group or an ethyl group contained in the organic metal gas, whereby a film of the compound containing the group 13 element and oxygen which hardness of the film formed at a low temperature is equal to that formed at a high temperature is favorably formed without giving damages to the surface of an organic matter (organic photosensitive layer) or the organic matter.

Specifically, the hydrogen gas concentration in the plasma-generating gas supplied for the activation is preferably about 10% by volume or more. If the hydrogen gas concentration is less than about 10% by volume, etching reaction insufficiently proceeds even at a low temperature, and an oxide compound of the group 13 element having a high content of hydrogen is generated, which may result in the formation of a film having insufficient water resistance and being unstable in the air.

In cases where the surface layer 3 is formed by plasma CVD, the abundance ratio of oxygen to gallium may be controlled by the supply of the gallium source and oxygen source. In this case, the molar ratio of the oxygen gas supply to the trimethylgallium (TMGa) gas supply, or $[O_2]/[TMGa]$ is preferably from 0.1 or about 0.1 to 10 or about 10.

Under other methods, the growth atmosphere may be controlled by changing the gas supply, and sputtering may be controlled by the proportion of gallium and oxygen contained in the target.

The surface temperature of the non-coated photoreceptor 50 during film formation is not particularly limited, however the surface temperature of an amorphous silicon photoreceptor is preferably from 50° C. to 350° C. during film formation, and that of an organic photoreceptor is preferably from 0° C. to 150° C. Especially, in the case of when the film is formed on the organic photoreceptor, it is preferable that the surface temperature of the non-coated photoreceptor 50 be 100° C. or less. In the case of when the surface temperature is higher than 150° C. due to the plasma even though the temperature of the untreated photoreceptor 50 is 150° C. or less, the organic photoreception layer may be damaged by heat. Thus, it is preferable to set the temperature of the non-coated photoreceptor 50 in consideration of the above-mentioned fact.

Additionally, the surface temperature of the non-coated photoreceptor 50 may be controlled using a method not shown, or a natural increase in temperature during the discharging may be used. In the case of when the non-coated photoreceptor 50 is heated, a heater may be provided out of the non-coated photoreceptor 50 or in the non-coated photoreceptor. In the case of when the non-coated photoreceptor 50 is cooled, cooling gas or liquid may circulate in the non-coated photoreceptor 50.

In order to avoid an increase in temperature of the non-coated photoreceptor 50 due to the discharge, it is preferable to control the flow of gas that comes into contact with the surface of the non-coated photoreceptor 50 and has high energy. In connection with this, conditions, such as the flow rate of gas, a discharge output, and a pressure, may be adjusted to obtain the desired temperature.

In the method of generating the plasma using the film forming apparatus 30 shown in FIG. 4, a high frequency oscillation device is used, but the device is not limited thereto. For example, a microwave oscillation device may be used, or an electro-cyclotron resonance type or helicon plasma type of device may be used. Furthermore, the high frequency oscillation device may be an inductance type or a capacitance type.

In an exemplary embodiment of the present invention, the plasma generating device includes the discharge electrode 54, the high frequency electric source 58, the matching box 56, the gas feeding pipe 34, the MFC 36, the pressure controller 38, and the gas feeding source 40, and one plasma generating device is used. However, two or more types of plasma generating devices may be used in combination, or two or more devices that are the same type may be used. Additionally, a capacitance combination type of plasma CVD device where a cylindrical electrode surrounds the cylindrical non-coated photoreceptor 50 may be used, or a device where the discharge occurs between the parallel plate electrode and the non-coated photoreceptor 50 may be used.

In the case of when two or more plasma generating devices that are different types are used, it is necessary to simultaneously form discharges using the same pressure. Furthermore, a difference in pressure may be formed in a discharge region and a film-forming region (on which the non-coated photoreceptor 50 is provided). The devices may be disposed in series with respect to the gas flow ranging from a gas inlet to a gas outlet in the treatment device, or the devices may be disposed so as to face the film-forming surface of the non-coated photoreceptor 50.

The discharge may be conducted in the vicinity of the atmospheric pressure. The term "in the vicinity of the atmospheric pressure" refers to a pressure of from 70,000 Pa to 110,000 Pa. In this case, the discharge is readily stabilized through the use of a rare gas such as He or Ar gas mixed with hydrogen.

The gas containing the group 13 element may be triethylgallium in place of trimethylgallium, or other organic metal compound containing indium or aluminum in place of gallium. These gases may be used in combination of two or more of them.

Hydrogen, oxygen, and the group 13 element activated by the above-described method reside on the photoreceptor, and the activated hydrogen desorbs hydrogen molecules from the hydrocarbon group such as a methyl group or an ethyl group composing the organic metal compound. Accordingly, the surface layer 3 is formed on the photoreceptor surface, wherein the surface layer 3 is composed of a hard film containing three-dimensional bonds between hydrogen, oxygen, and the group 13 element.

(Conductive Substrate and Photosensitive Layer)

The photoreceptor in accordance with the exemplary embodiment has an inorganic photosensitive layer or an organic photosensitive layer formed on a conductive substrate, and a surface layer. The photosensitive layer may be of function separation type wherein a charge generating layer and a charge transport layer are separated. In the structure of function separation type, either of the charge generating layer or the charge transport layer may be arranged on the surface side. Examples of the inorganic photosensitive layer include amorphous silicon and amorphous selenium. As necessary, an undercoat layer may be provided between the conductive substrate and the photosensitive layer. In addition, as described above, an intermediate layer such as a cushioning layer may be provided between the surface layer and the photosensitive layer.

The conductive base substance includes: a metal drum of for example aluminum, copper, iron, stainless, zinc, and nickel; a metal such as aluminum, copper, gold, silver, platinum, palladium, titanium, nickel-chromium, stainless steel, and copper-indium deposited on a base material such as a sheet, a paper, a plastic, and a glass; a conductive metal compound such as indium oxide and tin oxide deposited on the base material; a metal foil laminated on the base material; and carbon black, indium oxide, tin oxide-antimony oxide powder, metal powder, copper iodide, and the like dispersed into a binder resin and applied on the base material for conduction treatment. Moreover, the shape of the conductive base substance may be any one of drum shape, sheet shape, and plate shape.

Moreover, if a metal pipe base substance is used as the conductive base substance, the surface of the metal pipe base substance may be the original pipe as it is. However, it is also possible to roughen the surface of the base substance surface by a surface treatment in advance. Such a surface roughening can prevent the uneven concentration in the grain form due to the coherent light which may occur in the photoreceptor if a coherent light source such as a laser beam is used as an exposure light source. The method of surface treatment includes specular cutting, etching, anodization, rough cutting, centerless grinding, sandblast, and wet honing.

In particular, from the point of improving the adhesiveness with the photosensitive layer and improving the film forming property, one having an anodized surface of the aluminum base substance may be used as the conductive base substance.

Hereunder is a description of a method of manufacturing the conductive substrate having the anodized surface. First, as to the substrate, pure aluminum or aluminum alloy (for example, aluminum or aluminum alloy of number between 1000 and 1999, between 3000 and 3999, or between 6000 and 6999 defined in JIS, the disclosure of which is incorporated by reference) is prepared. Next, anodization is performed. The anodization is performed in an acid bath of for example chromic acid, sulfuric acid, oxalic acid, phosphoric acid, boric acid, and sulfamic acid. Treatment using a sulfuric acid bath is often used. The anodization is performed for example under a condition of about sulfuric acid concentration: from 10 weight % to 20 weight %: bath temperature: from 5° C. to 25° C., current density: from 1 A/dm$^2$ to 4 A/dm$^2$, bath voltage: from 5V to 30V, and treatment time: 5 minutes to 60 minutes, however it is not limited to this.

The anodized film formed on the aluminum substrate in this manner is porous and highly insulative, and has a very unstable surface. Therefore, after forming the film, the physical characteristics value is easily changed over time. In order to prevent this change of the physical characteristics value, the anodized film is further sealed. Example of the sealing methods include a method of soaking the anodized film in an aqueous solution containing nickel fluoride or nickel acetate, a method of soaking the anodized film in boiling water, and a method of treating by steam under pressure. Among these methods, the method of soaking in an aqueous solution containing nickel acetate is most often used.

On the surface of the anodized film that has been sealed in this manner, metal salts and the like adhered by the sealing remain in excess. If such metal salts and the like remain in excess on the anodized film of the substrate, not only the quality of the coating film formed on the anodized film is badly affected, but also low resistant components tend to remain in general. Therefore, if this substrate is used for the photoreceptor to form an image, it becomes the causative factor of scumming.

Here, following the sealing, washing of the anodized film is performed in order to remove the metal salts and the like adhered by the sealing. The washing may be such that the substrate is washed once, however it may be such that the substrate is washed by multisteps of washing. As this time, as the washing solution at the last washing step, there is used clean (deionized) washing solution as much as possible. Moreover, in any one step among the multisteps of washing, a physical rubbing washing using a contact member such as a brush may be performed.

The thickness of the anodized film on the surface of the conductive substrate formed as above is preferable within a range of 3 μm to 15 μm. On the anodized film is present a layer called a barrier layer along the porous shaped most outer surface of a porous anodized film. The thickness of the barrier layer is preferable in a range from 1 nm to 100 nm in the photoreceptor of an exemplary embodiment of the present invention. In the above manner, the anodized conductive substrate 1 can be obtained.

In the conductive substrate obtained in this manner, the anodized film formed on the substrate by anodization has a high carrier blocking property. Therefore, the photoreceptor using this conductive substrate can be installed in the image forming apparatus so as to prevent point defects (black dots and scumming) occurring if print off development (negative/positive development) is performed, and to prevent current leak phenomenon from a contact electrification device which often occurs at the time of contact electrification. Moreover, by sealing the anodized film, the change of the physical characteristics value over time after forming the anodized film, may be prevented. Moreover, by washing the conductive substrate after sealing, the metal salts and the like adhered on the surface of the conductive substrate by sealing may be removed. If an image is formed by an image forming apparatus comprising a photoreceptor produced using this conductive substrate, it is possible to sufficiently prevent the occurrence of scumming.

Regarding the photosensitive layer provided on the conductive substrate, the overview of a preferable structure having an amorphous silicon photoreceptor as the photosensitive layer is given below.

The amorphous silicon photoreceptor may be for positive charging or negative charging. The photoreceptor may be made by forming an undercoat layer on the conductive substrate thereby preventing charge injection and improving adhesiveness, and then forming thereon a light conductive layer and a surface layer. The surface layer may be formed on the surface of an undercoat layer provided as an intermediate layer on the photosensitive layer, or directly on the surface of the photosensitive layer.

The uppermost layer of the photosensitive layer (the layer on the surface layer side) may be p-type or n-type amorphous silicon, and an intermediate layer (charge injection inhibiting layer) such as $Si_xO_{(1-x)}$: H, $Si_xN_{(1-x)}$:H, $Si_xC_{(1-x)}$:H ($0 \leqq X \leqq 0.99$), or an amorphous carbon layer may be formed between the photosensitive layer and the surface layer.

The case where the photosensitive layer is an organic photoreceptor is further described below. In this case, the structure is composed mainly of a charge generating layer and a charge transport layer, and as necessary includes an undercoat layer and an intermediate layer as described above. Examples of the material of the under coating layer include: a polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol-formaldehyde resin, and a melamine resin; an organometallic compound containing zirconium, titanium, aluminum, manganese, silicon atoms, and the like.

These compounds may be used solely, or as a mixture or polycondensate of multiple compounds. Among them, an organometallic compound containing zirconium or silicon is preferably used since it has a low residual potential, low potential change due to environment, and low potential change due to repetitive usage. Moreover, the organometallic compound may be used solely, or as a mixture of two or more types, or a mixture with the abovementioned binder resin.

Examples of the organic silicon compound (organometallic compound containing silicon atoms) include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N, N-bis(β-hydroxyethyl)-γ-aminopropyltriethoxysilane, and γ-chloropropyltrimethoxysilane. Among them, there is preferably used a silane coupling agent such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropyltrimethoxysilane, N-2-(aminoethyl)3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Examples of the organic zirconium compound (organometallic compound containing zirconium) include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic titanium compound (organometallic compound containing titanium) includes tetraisopropyl titanate, tetranormalbutyl titanate, butyl titanate dimer, tetra (2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate and polyhydroxytitanium stearate.

The organic aluminum compound (organometallic compound containing aluminum) includes aluminum isopropylate, monobutoxyaluminum diisopropylate, aluminum butyrate, ethylacetoacetate aluminum diisopropylate and aluminum tris(ethylacetoacetate).

Moreover, examples of the solvent used for the under coating layer forming coating liquid which is for forming the under coating layer include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate. These solvents may be used solely or as a mixture of two or more types. As a solvent which can be used when two or more types of solvents are mixed, any solvent may be used as long as a binder resin can be dissolved therein as a mixed solvent.

In the formation of the under coating layer, firstly an under coating layer forming coating liquid that has been formulated by dispersing and mixing under coating layer coating agent and a solvent is prepared, and applied on the surface of the conductive substrate. As the application method of the under coating layer forming coating liquid, there may be used a normal method such as a dip coating method, a ring coating method, a wire bar coating method, a spray coating method, a blade coating method, a knife coating method, and a curtain coating method. If the under coating layer is formed, it is preferable to be formed so that the thickness is in a range from 0.1 μm to 3 μm. By setting the thickness of the under coating layer within such a thickness range, potential increase due to desensitization or repetition may be prevented without overstrengthening the electrical barrier.

In this manner, by forming the under coating layer on the conductive substrate, the wettability when coating to form a layer on the under coating layer may be improved, and it can sufficiently serve a function as an electrical blocking layer.

The surface roughness of the under coating layer formed by the above can be adjusted so as to have a roughness within a range between 1 and 1/(4n) times the laser wavelength λ for exposure to be used (where n is the refractive index of a layer provided on the periphery of the under coating layer). The surface roughness is adjusted by adding resin particles in the under coating layer forming coating liquid. By so doing, if the photoreceptor formed by adjusting the surface roughness of the under coating layer is used for the image forming apparatus, interference fringes due to the laser source may be sufficiently prevented. As the resin particles, there may be used silicone resin particles, crosslink-type PMMA resin particles, and the like. Moreover, for adjusting the surface roughness, the surface of the under coating layer may be ground. As the grinding method, there may be used buffing, sandblasting, wet honing, grinding treatment, and the like. In the photoreceptor used for the image forming apparatus of the configuration of positive electrification, laser incident beams are absorbed in the vicinity of the most outer surface of the photoreceptor, and further scattered in the photosensitive layer. Therefore, it is not so strongly needed to adjust the surface roughness of the under coating layer.

It is preferable to add various types of additives to the coating solution for forming the undercoat layer in order to improve electric properties, environmental safety, and the quality of image. Examples of the additives include an electron transport substance that includes a quinone-based compound, such as chloranyl, bromoanil, and anthraquinone, a tetracyanoquinodimethane-based compound, a fluorenone compound, such as 2,4,7-trinitrofluorenone and 2,4,5,7-tetranitro-9-fluorenone, an oxadiazol-based compound, such as 2-(4-biphenyl)-5-(4-t-butylphenyl)-1,3,4-oxadiazole, 2,5-bis(4-naphthyl)-1,3,4-oxadiazole, and 2,5-bis(4-diethyl aminophenyl)-1,3,4-oxadiazole, a xanthone-based compound, a thiophene compound, and a diphenoquinone compound, such as 3,3',5,5'-tetra-t-butyldiphenoquinone, an electron transport pigment, such as polycyclic condensates and azos, and a known material, such as a zirconium chelate compound, a titanium chelate compound, an aluminum chelate compound, a titanium alkoxide compound, an organic titanium compound, and a silane coupling agent.

Specific examples of the silane coupling agent used here include silane coupling agents such as vinyltrimethoxysilane, 7-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, it is not limited to these.

Specific examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphnate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl)titanate, titaniumacetylacetonate, polytitaniumacetylacetonate, titanium octylene glycolate, titanium lactate ammonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, ethylacetoacetate aluminum diisopropylate and aluminum tris(ethylacetoacetate). These additives may be used solely, or as a mixture or polycondensate of multiple compounds.

Moreover, the abovementioned under coating layer forming coating liquid may contain at least one type of electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferably used fluorenones, quinines, and benzene derivatives having an electron attractive substituent such as Cl, CN, and $NO_2$. As a result, in the photosensitive layer, the photosensitivity may be improved, the residual potential may be decreased, and the deterioration of photosensitivity when used repeatedly may be reduced. The uneven concentration of the toner image formed by the image forming apparatus including the photoreceptor containing an electron accepting material in the under coating layer may be sufficiently prevented.

Moreover, a dispersion type under coating layer coating agent described below is preferable to be used instead of the abovementioned under coating layer coating agent. As a result, by appropriately adjusting the resistance of the under coating layer, residual charge may be prevented from being accumulated, and the under coating layer may be made thicker. Therefore, the leak resistance of the photoreceptor may be improved, in particular, leaking at the time of contact electrification may be prevented.

This dispersion type under coating layer coating agent may be, for example, those obtained by dispersing, in a binder resin, metal powder such as aluminum, copper, nickel, and silver; conductive metal oxide such as antimony oxide, indium oxide, tin oxide, and zinc oxide; and conductive material such as carbon fiber, carbon black, and graphite powder. As the conductive metal oxide, metal oxide particles having a mean primary particle size of 0.5 μm or less are preferably used. If the mean primary particle size is too large, conduction paths are often generated locally, readily causing current leaking, which may result in the occurrence of fogging or leaking of large current from the electrification device. The under coating layer is needed to be adjusted to an appropriate resistance in order to improve the leak resistance. Therefore, the abovementioned particles having a mean primary particle size of 0.5 μm or less are preferable to have a powder resistance of $10^2$ Ω·cm to $10^{11}$ Ω·cm or less.

If the resistance of the metal oxide particle is lower than the lower limit of the above range, sufficient leak resistance may not be obtained. If it is higher than the upper limit of this range, the residual potential may be increased. Consequently, among them, metal oxide particles such as stannic oxide, titanium oxide, and zinc oxide are preferably used. Moreover, the metal oxide particles may be used in a mixture of two or more types thereof. Furthermore, by performing the surface treatment on the metal oxide particles using a coupling agent, the resistance of the powder may be controlled. As the coupling agent that may be used in this case, similar materials as those for the abovementioned under coating layer forming coating liquid can be used. Moreover, these coupling agents may be used in a mixture of two or more types thereof In this surface treatment of the metal oxide particles, any publicly known method can be used, and either a dry method or wet method may be used.

If a dry method is used, firstly the metal oxide particles are heated and dried, to remove the surface adsorbed water. By removing the surface adsorbed water, the coupling agent may be evenly adsorbed on the surface of the metal oxide particles. Next, while stirring the metal oxide particles by a mixer or the like having a large shearing force, the coupling agent, either directly or dissolved in an organic solvent or water, is dropped or sprayed with dry air or nitrogen gas, and thereby the treatment is evenly performed. When the coupling agent is dropped or sprayed, the treatment may be performed at a temperature of 50° C. or more. After adding or spraying the coupling agent, printing may be further performed at a temperature of 100° C. or more. By the effect of the printing, the coupling agent can be cured and a firm chemical reaction with the metal oxide particles can be generated. The printing may be performed at a temperature at which a desired electrophotographic characteristic is obtained, for any range of time.

If a wet method is used, similarly to the dry method, firstly the surface adsorbed water on the metal oxide particles is removed. As the method of removing the surface adsorbed water, in addition to the heat and dry method which is similar to the dry method, there may be performed a method of removing by stirring and heating in a solvent used for surface treatment, and a method of removing by azeotroping with a solvent. Next, the metal oxide particles are stirred in a solvent, and dispersed by using ultrasonic waves, a sandmill, an attritor, a ball mill, or the like. The coupling agent solution is added thereinto, and stirred or dispersed. Then, the solvent is removed, and thereby the treatment is evenly performed. After removing the solvent, printing may be further performed at a temperature of 100° C. or more. The printing may be performed at a temperature at which a desired electrophotographic characteristic is obtained, for any range of time.

The amount of the surface treatment agent with respect to the metal oxide particles may be an amount by which a desired electrophotographic characteristic is obtained. The electrophotographic characteristic is affected by the amount of the surface treatment agent adhered on the metal oxide particles after surface treatment. In the case of the silane coupling agent, the adhered amount is obtained by the Si intensity measured by fluorescent X-ray spectroscopy (caused by silane coupling agent), and the intensity of the main metal element used in the metal oxide. The Si intensity measured by fluorescent X-ray spectroscopy may be within a range of from $1.0\times10^{-5}$ times to $1.0\times10^{-3}$ times of the intensity of the main metal element used in the metal oxide. If it is lower than this range, image defects such as blushing may often occur. If it exceeds this range, the concentration may be often decreased due to an increase in the residual potential.

Examples of the binding resin contained in the dispersion type under coating layer coating agent include: a publicly known polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and an urethane resin; a charge transport resin having a charge transport group; and a conductive resin such as polyaniline.

Among them, there is preferably used a resin that is insoluble in a coating solvent of a layer formed on the under coating layer. In particular, a phenol resin, a phenol-formaldehyde resin, a melamine resin, an urethane resin, an epoxy resin, and the like are preferably used. The ratio of the metal oxide particles to the binder resin in the dispersion type under coating layer forming coating liquid may be arbitrarily set within a range by which a desired photoreceptor characteristic may be obtained.

Examples of the method of dispersing the metal oxide particles that have been surface treated by the above method into the binder resin, include a method using a media disperser such as a ball mill, a vibratory ball mill, an attritor, a sandmill, and a horizontal sandmill, or a medialess disperser such as an agitator, an ultrasonic disperser, a roll mill, and a high pressure homogenizer. Furthermore, examples of the high voltage homogenizer include a collision method where a dispersing liquid is dispersed by liquid-liquid collision or liquid-wall collision under a high pressure, and a penetration method where a dispersing liquid is dispersed by making it penetrate through minute channels under a high pressure.

The method of forming the under coating layer by this dispersion type under coating layer coating agent can be performed similarly to the method of forming the under coating layer using the abovementioned under coating layer coating agent.

Next is a description of the photosensitive layer, separately for the charge transport layer and the charge generation layer in this order.

Examples of the charge transport material used for the charge transport layer 2B are as follows. That is, there is used a hole transport material such as: oxadiazoles such as 2,5-bis (p-diethylaminophenyl)-1,3,4-oxadiazole; pyrazolines such as 1,3,5-triphenyl-pyrazoline, and 1-[pyridyl-(2)]-3-(p-diethylaminostyryl)-5-(p-diethylaminostyryl)pyrazoline; an aromatic tertiary amino compound such as triphenylamine, tri(p-methyl)phenylamine, N,N-bis(3,4-dimethylphenyl)biphenyl-4-amine, dibenzylaniline, and 9,9-dimethyl-N,N-di (p-tolyl)fluorenone-2-amine; an aromatic tertiary diamino compound such as N,N'-diphenyl-N,N'-bis(3-methylphenyl)-[1,1-biphenyl]-4,4'-diamine; 1,2,4-triazines such as 3-(4'dimethylaminophenyl)-5,6-di-(4'-methoxyphenyl)-1,2,4-triazine; hydrazones such as 4-diethylaminobenzaldehyde-1,1-diphenylhydrazone, 4-diphenylaminobenzaldehyde-1,1-diphenylhydrazone, [p-(diethylamino)phenyl](1-naphthyl) phenylhydrazone, 1-pyrenediphenylhydrazone, 9-ethyl-3-[(2methyl-1-indolinylimino)methyl]carbazole, 4-(2-methyl-1-indolinyliminomethyl)triphenylamine, 9-methyl-3-carbazolediphenylhydrazone, 1,1-di-(4,4'-methoxyphenyl) acrylaldehydediphenylhydrazone, and β,β-bis (methoxyphenyl)vinyldiphenylhydrazone; quinazolines such as 2-phenyl-4-styryl-quinazoline; benzofurans such as 6-hydroxy-2,3-di(p-methoxyphenyl)-benzofuran; α-stilbenes such as p-(2,2-diphenylvinyl)-N,N-diphenylaniline; enamines; carbazoles such as N-ethylcarbazole; poly-N-vinylcarbazole and the derivatives thereof. Examples thereof further include a polymer having a group including any of the above compounds on the main chain or side chain. These charge transport materials may be used solely or in combination of two or more types thereof.

Any binder resin may be used as the binder resin used for the charge transport layer. However, in particular, preferably the binder resin is compatible with the charge transport material and has an appropriate strength.

Examples of this binder resin include: various polycarbonate resins of bisphenol A, bisphenol Z, bisphenol C, bisphenol TP, and the like, and the copolymer thereof; a polyalylate resin and the copolymer thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, an styrene-alkyd resin; a poly-N-vinylcarbazole resin; a polyvinyl butyral resin; and a polyphenylene ether resin. These resins may be used solely, or as a mixture of two or more types thereof.

The molecular weight of the binder resin used for the charge transport layer is appropriately selected according to the film-forming condition such as the thickness of the photosensitive layer 2 and the kind of solvent, and usually it is preferably in the range from 3,000 to 300,000 and more preferably from 20,000 to 200,000 in the viscosity-average molecular weight.

The compounding ratio of the charge transport material to the binder resin is preferable in the range from 10:1 to 1.5.

The charge transport layer and/or the charge Generation layer described later may contain additives such as an antioxidant, a photostabilizer, and a thermal stabilizer, in order to prevent the deterioration of the photoreceptor due to ozone or oxidizing gas generated in the image forming apparatus, light, or heat.

Examples of the antioxidant include hindered phenol, hindered amine, paraphenylendiamin, arylalkane, hydroquinone, spirochromans, spiroindanone, or the derivatives thereof, an organic sulfur compound, and an organophosphorus compound.

Specific examples of the compound of the antioxidant include: a phenolic antioxidant such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenylacrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane, 3-3',5'-di-t-butyl-4'-hydroxyphenyl)stearyl propionate.

Examples of the hindered amine compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, succinic acid dimethyl-1-(2-hydroxyethyl)-4-hydroxy-2,2,6,6-tetramethylpiperidine polycondensate, poly[{6-(1,1,3,3-tetramethylbutyl)amino-1,3,5-triazine-2,4-diyl} {(2,2,6,6-tetramethyl-4-piperidyl) imino}hexamethylene{(2,3,6,6-tetramethyl-4-piperidyl) imino}], 2-(3,5-di-t-butyl-4-hydroxybenzyl)-2-n-butyl malonic acid bis(1,2,2,6,6-pentamethyl-4-piperidyl), and N,N'-bis(3-aminopropyl)ethylenediamine-2,4-bis[N-butyl-N-(1,2,2,6,6,-pentamethyl-4piperidyl)amino]-6-chloro-1,3,5-triazine condensate.

Examples of the organic sulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of the organophosphorus antioxidant include trisnonylphenylphosphate, triphenylphosphate, and tris(2,4-di-t-butylphenyl)-phosphate.

The organic sulfur antioxidants and organophosphorus antioxidants are called a secondary antioxidant, which can increase the antioxidative effect synergistically when used with a primary antioxidant such as a phenol or amine.

Examples of the photostabilizer includes benzophenones, benzotriazoles, dithiocarbamates, and tetramethylpiperidines.

Examples of the benzophenone photostabilizer include 2-hydroxy-4-methoxybenzophenone, 2-hydroxy-4-octoxybenzophenone, and 2,2'-di-hydroxy-4-methoxybenzophenone.

Examples of the benzotriazole photostabilizer includes 2-(-2'-hydroxy-5'methylphenyl-)-benzotriazole, 2-[2'-hydroxy-3'-(3",4",5",6"-tetra-hydrophthalimide-methyl)-5'-methylphenyl]-benzotriazole, 2-(-2'-hydroxy-3'-t-butyl 5'-methylphenyl-)-5-chlorobenzotriazole, 2-(2'-hydroxy-3'-t-butyl-5'-methylphenyl-)-5-chloro benzotriazole, 2-(2'-hydroxy-3',5'-t-butylphenyl-)-benzotriazole, 2-(2'-hydroxy-5'-t-octylphenyl)-benzotriazole, and 2-(2'-hydroxy-3',5'-di-t-amylphenyl-)-benzotriazole.

Examples of other photostabilizers include 2,4, di-t-butylphenyl-3',5'-di-t-butyl-4'-hydroxybenzoate, and nickel dibutyl-dithiocarbamate.

The charge transport layer can be formed by applying and drying a solvent having the charge transport material and the binder resin dissolved in an appropriate solvent. Examples of the solvent used for adjusting the charge transport layer forming coating liquid include: aromatic hydrocarbons, such as benzene, toluene, and chlorobenzene; ketones such as acetone and 2-butanone; halogenated aliphatic hydrocarbons such as methylene chloride, chloroform, and ethylene chloride; cyclic or linear ethers such as tetrahydrofuran, dioxane, ethylene glycol, diethylether; and mixed solvents thereof.

Moreover, the charge transport layer forming coating liquid may be added with a small amount of silicone oil as a leveling agent for improving the smoothness of the coating film formed by coating.

The application of the charge transport layer forming coating liquid can be performed according to the shape and usage of the photoreceptor, by using a method such as a dip coating method, a ring coating method, a spray coating method, a bead coating method, a blade coating method, a roller coating method, a knife coating method, and a curtain coating method. It is preferable to be heated and dried after becoming dry to touch at a room temperature. The heating and drying may be performed in a temperature range of 30° C. to 200° C., for 5 minutes to 2 hours.

The film thickness of the charge transport layer may be preferably in a range of 5 μm to 50 μm, and more preferably in a range of 10 μm to 40 μm.

The charge generation layer may be formed by deposition of a charge generating material by a vacuum deposition method, or coating of a solution containing an organic solvent and a binder resin.

As to the charge generating material, there may be used: amorphous selenium, crystalline selenium, selenium-tellurium alloy, selenium-arsenic alloy, and other selenium compounds; an inorganic photoconductor such as selenium alloy, zinc oxide, and titanium oxide; or a dye-sensitized material thereof; various phthalocyanine compound such as metal-free phthalocyanine, titanyl phthalocyanine, copper phthalocyanine, tin phthalocyanine, and galliumphthalocyanine; various organic pigments such as squaryliums, anthanthrones, perylenes, azos, anthraquinones, pyrenes, pyrylium salt, and thia pyrylium salt; or dyes.

Moreover, these organic pigments generally have several types of crystal forms. In particular, for the phthalocyanine compound, various crystal forms are known such as α type and β type. As long as the pigment provides the sensitivity or other characteristics according to the purpose, any of these crystal forms can be used.

Among the abovementioned charge generating materials, phthalocyanine compounds are preferred. In this case, if light is irradiated on the photosensitive layer, the phthalocyanine compound contained in the photosensitive layer absorbs photons and generates carriers. At this time, since the phthalocyanine compound has a high quantum efficiency, the absorbed photons can be efficiently absorbed to generate carriers.

Furthermore, among the phthalocyanine compound, the phthalocyanine as shown in the following (1) to (3) are more preferred. That is:

(1) Hydroxy gallium phthalocyanine of a crystal form having diffraction peaks at least in the positions of 7.6°, 10.0°, 25.2°, and 28.0° in the Bragg angle (2θ±0.2°) of an X-ray diffraction spectrum using Cu kα rays as a charge generating material.

(2) Chlorogallium phthalocyanine of a crystal form having diffraction peaks at least in the positions of 7.3°, 16.5°, 25.4°, and 28.1° in the Bragg angle (2θ±0.2°) of an X-ray diffraction spectrum using Cu kα ray as a charge generating material, (3) Titanyl phthalocyanine of a crystal form having diffraction peaks at least in the positions of 9.5°, 24.2°, and 27.3° in the Bragg angle (2θ±0.2°) of an X-ray diffraction spectrum using Cu kα ray as a charge generating material.

These phthalocyanine compounds have not only high photosensitivity in particular, but also high stability of the photosensitivity. Therefore, the photoreceptor having the photosensitive layer containing any one of these phthalocyanine compounds is preferably used as a photoreceptor of a color image forming apparatus which requires high speed image formation and repetitive reproducibility.

Due to the crystal shape and the measurement method, these peak intensity and the position may be slightly out from these values. However, as long as the X-ray diffraction pattern is basically matched, it can be judged to be the same crystal form.

Examples of the binder resin used for the charge generation layer include the following. That is, polycarbonate resins such as bisphenol A type and bisphenol Z type, and the copolymer thereof; a polyalylate resin; a polyester resin; a methacrylic resin; an acrylic resin; a polyvinylchloride resin; a polystyrene resin; a polyvinyl acetate resin; a styrene-butadiene copolymer resin; a vinylidene chloride-acrylnitryl copolymer resin; a vinyl chloride-vinyl acetate-maleic anhydride copolymer resin; a silicone resin; a silicone-alkyd resin; a phenol-formaldehyde resin; styrene-alkyd resin; and a poly-N-vinylcarbazole.

These binder resins may be used solely or in combination of two or more types thereof. The mixing ratio of the charge generation material and the binder resin (charge generation material: binder resin) is desirably within a range between 10:1 and 1:10 by weight ratio. Moreover, generally, the thickness of the charge generation layer is preferably in a range from 0.01 μm to 5 μm, and more preferably in a range from 0.05 μm to 2.0 μm.

Moreover, the charge generation layer may contain at least one type of electron accepting material in order to improve the sensitivity, decrease the residual potential, and decrease the fatigue at the time of repetitive usage. Examples of the electron accepting material used for the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferred fluorenones, quinines, and benzenes having an electron attractive substituent such as Cl, CN, and $NO_2$.

As the method of dispersing the charge generating material into a resin, there may be used a method such as a roll mill, a ball mill, a vibratory ball mill, an attritor, a dinomill, a sandmill, and a colloid mill.

Examples of the solvent of the coating liquid for forming the charge generation layer include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate.

These solvents may be used solely or as a mixture of two or more types. If two or more types of solvents are mixed, any solvent may be used as long as a binder resin can be dissolved therein as a mixed solvent. However, if the photosensitive layer has a layer structure where the charge transport layer 2B and the charge generation layer are formed in this order from the conductive substrate side, when the charge generation layer is formed using an application method such as dip coating in which the lower layer is readily dissolved, a solvent which does not dissolve the lower layer such as the charge transport layer is desirably used. Moreover, when the charge generation layer 2A is formed using a spray coating method or a ring coating method, in which the lower layer is eroded relatively less, the solvent can be widely selected.

As to the intermediate layer, for example when the photoreceptor surface is electrified by an electrification device, in order to prevent a situation where the electrification potential can not be obtained by injecting the electrification charges from the photoreceptor surface to the conductive substrate of the photoreceptor serving as the opposed electrode, a charge injection blocking layer may be formed as required between the surface layer and the charge generation layer.

As to the material of the charge injection blocking layer, there may be used the abovementioned silane coupling agent, titanium coupling agent, organic zirconium compound, and organic titanium compound, other organometallic compounds, and a widely-used resin such as polyester, and polyvinyl butyral. The thickness of the charge injection blocking layer is appropriately set by considering the film forming property and the carrier blocking property, in a range from 0.001 μm to 5 μm.

<Process Cartridge and Image Forming Apparatus>

Next, process cartridges and image forming apparatuss including the photoreceptor of the invention are described with reference to exemplary embodiments thereof.

Figure 5:
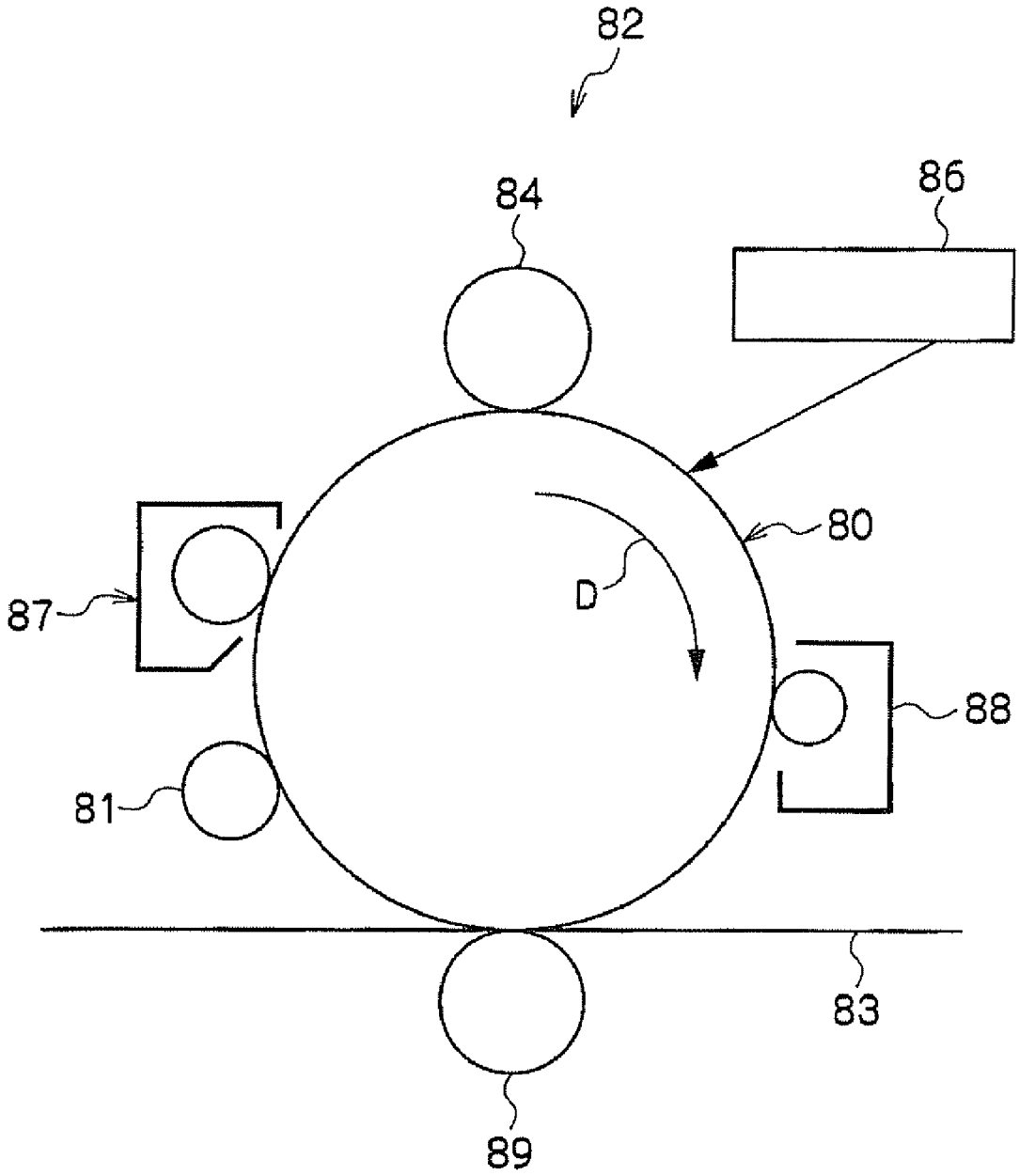
FIG. 5 is a schematic block diagram showing an example of the process cartridge and image forming apparatus of the invention.

As shown in FIG. 5, the image forming apparatus 82 of the exemplary embodiment of the invention is provided with an electrophotographic photoreceptor 80 that rotates in a predetermined direction (the direction D of the arrow in FIG. 5).

A charging unit 84, an exposing unit 86, a developing unit 88, a transferring unit 89, an erasing unit 81, and a cleaning member 87 are formed along the rotation direction of the electrophotographic photoreceptor 80 in the vicinity of the electrophotographic photoreceptor 80.

The charging unit 84 electrically charges the surface of the electrophotographic photoreceptor 80 so that the surface has a predetermined potential. The exposing unit 86 exposes the surface of the electrophotographic photoreceptor 80 that is electrically charged by the charging unit 84 to form an electrostatic latent image according to image data. The developing unit 88 stores a developer containing the toner for developing the electrostatic latent image, and supplies the stored developer to the surface of the electrophotographic photoreceptor 80 to develop the electrostatic latent image, thereby forming a toner image.

The transferring unit 89 transfers the toner image formed on the electrophotographic photoreceptor 80 while a recording medium 83 is sandwiched between the electrophotographic photoreceptor 80 and the transferring device, thereby transferring the image onto the recording medium 83. The toner image that is transferred on the recording medium 83 is fixed to the surface of the recording medium 83 using a fixing unit now shown.

The erasing unit 81 removes electricity from the substance that is attached to the surface of the electrophotographic photoreceptor 80 and electrically charged. The cleaning member 87 is provided to come into contact with the surface of the electrophotographic photoreceptor 80, and removes the substance attached to the surface using friction force to the surface of the electrophotographic photoreceptor 80.

Additionally, the image forming apparatus 82 of the exemplary embodiment of the invention may be a tandem apparatus that is provided with a plurality of electrophotographic photoreceptors 80 corresponding to the toners of the various colors. Further, transferring of the toner image onto the recording medium 83 may be performed using an internal transferring process where the toner image formed on the surface of the electrophotographic photoreceptor 80 is transferred onto an internal transfer body and then onto the recording medium.

The process cartridge of the exemplary embodiment of the invention is removably provided with respect to the main body of the image forming apparatus 89, and is united with at least the charging unit 84, and at least one selected from the group consisting of the developing unit 88, the cleaning member 87, and the erasing unit 81. In the exemplary embodiment of the invention, the cleaning unit is not particularly limited, however preferably is a cleaning blade. Usually, a cleaning blade is more damaging and more abrasive to the photoreceptor surface in comparison with other cleaning units.

However, the process cartridge and the image forming apparatus 82 in accordance with the exemplary embodiment of the invention are composed of the electrophotographic photoreceptor of the invention, which suppresses the increase of the residual potential caused by repeated use in an electrophotographic process and has a surface layer having sufficient hardness and thickness for improving the abrasion resistance, so that the occurrence of scratches and abrasion on the surface of the electrophotographic photoreceptor are suppressed over a long period of use, which results in production of favorable images.

EXAMPLES

Hereunder is a specific description of exemplary embodiments of the present invention with reference to Examples. However, the present invention is not limited to these Examples.

Example 1

(Making of Electrophotographic Photoreceptor)

—Formation of Undercoat Layer—

100 parts by weight of zinc oxide (average particle diameter: 70 nm, prototype manufactured by Tayca Corporation) are mixed with 500 parts by weight of toluene under stirring. To the mixture 1.5 parts by weight of a silane coupling agent (trade name: KBM603, manufactured by Shin-Etsu Chemical Co., Ltd.) are added and stirred for 2 hours. Subsequently, toluene is removed by distillation under reduced pressure, and baking is conducted at 150° C. for 2 hours.

To a solution prepared by dissolving 60 parts by weight of zinc oxide which has been subjected to surface treatment in the way mentioned above, 15 parts by weight of curing agent (blocked isocyanate, commercial name: Sumidur BL3175, produced by Sumika Bayer Urethane Co., Ltd.), and 15 parts by weight of butyral resin (commercial name: S-LEC BM-1, produced by Sekisui Chemical Co., Ltd.) in 85 parts by weight of methyl ethyl ketone, 25 parts by weight of methyl ethyl ketone is mixed to yield a liquid to be treated.

Next, using a horizontal media mill disperser (KDL-PILOT type, DYNO-MILL, produced by Shinmaru Enterprises Corporation), dispersion treatment is performed in the following procedures. The cylinder and stirring mill of the disperser are composed of ceramics including zirconia as the principal component. Into the cylinder, glass beads 1 mm in diameter (Hi-Bea D20, produced by Ohara Inc.) are charged in a bulk filling factor 80 volume %, followed by dispersion treatment in a circulation system at a peripheral speed of the stirring mill of 8 m/min and a flow rate of the liquid to be treated of 1000 mL/min. A magnet gear pump is used for sending the liquid to be treated.

In the above-mentioned dispersion treatment, a part of the liquid to be treated is sampled after a specified time elapse, and the transmittance at the time of film formation is measured. That is, the liquid to be treated is applied to a glass plate so that it might have a thickness of 20 μm, and a coating is formed by performing curing treatment at 150° for 2 hours. Thereafter, the transmittance at a wavelength of 950 nm is measured using a spectrophotometer (U-2000, produced by Hitachi, Ltd.). The dispersion treatment is completed when the transmittance (value at a coating thickness of 20 μm) exceeded 70%.

A under coating layer forming coating liquid is prepared by adding 0.005 parts by weight of dioctyltin dilaurate as a catalyst and 0.01 parts by weight of silicone oil (commercial name: SH29PA, produced by Dow Coming Toray Silicone Co., Ltd.) to the dispersion obtained in the way described above. This coating liquid is applied by dip coating to an aluminum substrate having a diameter of 84 mm, a length of 340 mm and a thickness of 1 mm, followed by dry hardening at 160° C. for 100 minutes. Thus, an under coating layer having a thickness of 20 μm is formed.

—Formation of Photosensitive Layer—

Next, a photosensitive layer is formed on the under coating layer. A mixture composed of 15 parts by weight of chlorogallium phthalocyanine of a crystal form having diffraction peaks at least in the positions of 7.4°, 16.6°, 25.5°, and 28.3° in the Bragg angle (2θ±0.2°) of an X-ray diffraction spectrum using Cukα ray as a charge generating material, 10 parts by weight of vinyl chloride-vinyl acetate copolymer resin (commercial name: VMCH, produced by Nippon Unicar Co., Ltd.) as a binder resin, and 300 parts by weight of n-butyl alcohol is subjected to dispersion treatment for 4 hours in a sand mill using glass beads having a diameter of 1 mm. Thus, a charge transport layer forming coating liquid is obtained. The resulting dispersing liquid is applied to the under coating layer by dip coating and then dried. Thus, a charge generation layer having a thickness of 0.2 μm is formed.

Further, a charge transport layer forming coating liquid is prepared by adding 4 parts by weight of N,N-diphenyl-N,N'-bis(3-methylphenyl)-[1,1']biphenyl-4,4'-diamine and 6 parts by weight of bisphenol Z polycarbonate resin (viscosity average molecular weight: 40000) to 80 parts by weight of chlorobenzene and dissolving them. This coating liquid is applied to the charge generation layer and then dried at a temperature of 130° C. for 40 min to form a charge transport layer having a thickness of 25 μm. Thus, an organic photoreceptor (non-coated photoreceptor) is obtained.

—Formation of Surface Layer—

Subsequently, a surface layer is formed on the non-coated photoreceptor by plasma CVD. A piece of Si substrate (5 mm×10 mm) for making a reference sample is attached to the non-coated photoreceptor using an adhesive tape, mounted on the plasma CVD apparatus shown in FIG. 4, and the inside of the vacuum chamber 32 is evacuated to a pressure of $1\times10^{-2}$ Pa. Subsequently, 200 sccm of hydrogen gas, 5 sccm of He-diluted oxygen (4%), and 5 sccm of hydrogen-diluted trimethylgallium (about 10%) are supplied to the vacuum chamber 32 through the gas feeding pipe under control by the mass flow controller 36. Simultaneously, the pressure in the vacuum chamber 32 is adjusted to 20 Pa by the conductance valve, the output of a radio wave of 13.56 MHz is adjusted to 80 W by the high frequency electric source 58 and the matching box 56, and matching is accomplished by the tuner. Subsequently electricity is discharged from the discharge electrode 54, wherein the reflection wave is 0 W. In that state, a film is formed under rotating at 20 rpm for 73 minutes thereby making a photoreceptor having a surface layer. The hydrogen-diluted trimethylgallium gas is supplied by bubbling hydrogen carrier gas into trimethylgallium kept at 0° C. The color of the attached thermotape indicates that the temperature during film formation is about 40° C. or less. The obtained photoreceptor is allowed to stand at a temperature of 20° C. for 24 hours. The thermotape used here is a sticker for measuring temperature (commercial name: Temp Plate P/N101, produced by Wahl Co., Ltd).

—Analysis and Evaluation of Surface Layer—

A cleaved section of the Si sample is observed by a scanning electron microscope (SEM); the thickness of the layer is 0.31 μm.

The composition of the film formed on the Si sample is analyzed by Rutherford Back Scattering (RBS) and Hydrogen Forward Scattering (HFS), and it is found that the elemental composition of gallium, oxygen, and hydrogen are 36 atom %, 44 atom %, and 20 atom %, respectively (total composition ratio of the three elements: 1.0), and the abundance ratio of oxygen to gallium is 1.22.

(Evaluation of Electrophotographic Photoreceptor)

—Potential Characteristics—

Subsequently, the potential characteristics of the electrophotographic photoreceptor having the protective layer is evaluated. In the first place, the surfaces of the non-coated photoreceptor before the formation of the surface layer and the photoreceptor having the surface layer are irradiated with exposing light (light source: semiconductor laser, wavelength: 780 nm, output: 5 mW) in a scanning manner with the photoreceptors rotated at 40 rpm under charging to −700 V by a scorotron electrifier.

Thereafter, the potential of the photoreceptor is examined by measurement using a surface potentiometer (Model 344, manufactured by Trek Japan Corporation) and a probe having a measurement area width of 10 mm (Model 555P-1, manufactured by Trek Japan Corporation), wherein the probe placed at a distance of 2 mm from the photoreceptor is mapped by scanning in the direction of the drum axis and the direction of drum rotation, and the potential (residual potential) of the photoreceptor is examined. As a result of this, it is found that the potential of the non-coated photoreceptor is −20 V, while that of the photoreceptor having the surface layer is 27 V, which is a potential at a favorable level.

Furthermore, charging and exposure under the above-described conditions are repeated 100 cycles, and then the residual potential of the non-coated photoreceptor and the photoreceptor having the surface layer are measured in the same manner as described above; the residual potential of the non-coated photoreceptor is −22 V, while that of the photoreceptor having the surface layer is −30 V.

—Image Characteristics—

Next, the electrophotographic photoreceptor in which the protective layer has been formed is installed as a photoreceptor into a process cartridge for DOCUCENTRE COLAR 500 produced by Fuji Xerox Co., Ltd. The process cartridge is attached to a DocuCentre Colar 500 and a print test of forming images (300 dpi, 30% area coverage) on an A4-sized paper (commercial name: P PAPER, produced by Fuji Xerox Office Supply Co., Ltd.) is conducted.

10,000 sheets are output under the above-described conditions, and the output image sample of the 10,000th sheet is evaluated on the image quality on the basis of the following criteria:

A: no abnormality detected in image density and dot reproducibility;

B: reduced image density, or partial dot missing and vertical streaks occur at acceptable levels; and C: significantly reduced image density or vertical streaks occur at unacceptable levels.

All the results are summarized in Table 1.

Example 2

An electrophotographic photoreceptor having a surface layer is made in the same manner as Example 1, except that the oxygen supply during the formation of the surface layer is 8.5 sccm and the film formation time is 65 minutes.

The section of the photoreceptor is observed by SEM in the same manner as Example 1; the thickness is 0.29 μm. The elemental composition is analyzed in the same manner as Example 1, and it is found that the elemental composition of gallium, oxygen, and hydrogen are 35 atom %, 48 atom %, and 17 atom %, respectively (total composition ratio of the three elements: 1.0), and the abundance ratio of oxygen to gallium is 1.37.

The electrophotographic characteristics of the photoreceptor are evaluated in the same manner as Example 1. The results are summarized in Table 1.

Examples 3

An electrophotographic photoreceptor having a surface layer is made in the same manner as Example 1, except that the oxygen supply during the formation of the surface layer is 20 sccm and the film formation time is 60 minutes.

The section of the photoreceptor is observed by SEM in the same manner as Example 1; the thickness is 0.30 μm. The elemental composition is analyzed in the same manner as Example 1, and it is found that the elemental composition of gallium, oxygen, and hydrogen are 35 atom %, 50 atom %, and 15 atom %, respectively (total composition ratio of the three elements: 1.0), and the abundance ratio of oxygen to gallium is 1.43.

The electrophotographic characteristics of the photoreceptor are evaluated in the same manner as Example 1. The results are summarized in Table 1.

Example 4

An electrophotographic photoreceptor having a surface layer is made in the same manner as Example 1, except that the film formation time is 30 minutes.

The section of the photoreceptor is observed by SEM in the same manner as Example 1; the thickness is 0.1 μm. The elemental composition is analyzed in the same manner as Example 1, and it is found that the elemental composition of gallium, oxygen, and hydrogen are 35 atom %, 50 atom %, and 15 atom %, respectively (total composition ratio of the three elements: 1.0), and the abundance ratio of oxygen to gallium is 1.43.

The electrophotographic characteristics of the photoreceptor are evaluated in the same manner as Example 1. The results are summarized in Table 1.

Example 5

An electrophotographic photoreceptor having a surface layer is made in the same manner as Example 1, except that the film formation time is 40 minutes.

The section of the photoreceptor is observed by SEM in the same manner as Example 1; the thickness is 0.18 μm. The elemental composition is analyzed in the same manner as Example 1, and it is found that the elemental composition of gallium, oxygen, and hydrogen are 36 atom %, 44 atom %, and 20 atom %, respectively (total composition ratio of the three elements: 1.0), and the abundance ratio of oxygen to gallium is 1.22.

The electrophotographic characteristics of the photoreceptor are evaluated in the same manner as Example 1.

Example 6

An electrophotographic photoreceptor having a surface layer is made in the same manner as Example 1, except that the film formation time is 480 minutes.

The section of the photoreceptor is observed by SEM in the same manner as Example 1; the thickness is 2.1 μm. The elemental composition is analyzed in the same manner as Example 1, and it is found that the elemental composition of gallium, oxygen, and hydrogen are 36 atom %, 44 atom %, and 20 atom %, respectively (total composition ratio of the three elements: 1.0), and the abundance ratio of oxygen to gallium is 1.22.

The electrophotographic characteristics of the photoreceptor are evaluated in the same manner as Example 1, however the output of half tone images is failed. Then, the amount of light of the exposing laser of DocuCentre Color 500 is increased five times, and normal half tone images are obtained. On this account, the characteristics of the image are evaluated under the fivefold amount of light of the exposing laser. Exposing light for the evaluation of the potential characteristics is also increased five times (25 mW). The results are summarized in Table 1.

Example 7

A cylindrical Al substrate having a thickness of 1 mm is mounted on a plasma CVD apparatus for cylindrical substrate, and a charge injection inhibiting layer composed of n-type $SiN_{0.5}$ having a thickness of 3 μm, a photosensitive layer composed of i-type amorphous silicon having a thickness of 20 μm, and a charge injection inhibiting surface layer composed of p-type $Si_2C$ having a thickness of 0.5 μm are formed in this order, whereby a negatively charged amorphous silicon photoreceptor is obtained. A surface layer is formed on the surface of the photoreceptor under the same conditions as Example 1 using the same film forming apparatus as Example 1 which has a structure shown in FIG. 4, and thus an amorphous silicon photoreceptor having a surface layer is obtained.

The amorphous silicon photoreceptor having the surface layer is evaluated in the same manner as Example 1, except that the surface potential is changed to −400 V, and the amount of light is adjusted using a laser having a wavelength of 650 nm.

The results including the analysis of the surface layer are summarized in Table 1.

Comparative Example 1

An electrophotographic photoreceptor having a surface layer is made in the same manner as Example 1, except that the oxygen supply during the formation of the surface layer is 3 sccm and the film formation time is 85 minutes.

The section of the photoreceptor is observed by SEM in the same manner as Example 1; the thickness is 0.32 μm. The elemental composition is analyzed in the same manner as Example 1, and it is found that the elemental composition of gallium, oxygen, and hydrogen are 38 atom %, 41 atom %, and 21 atom %, respectively (total composition ratio of the three elements: 1.0), and the abundance ratio of oxygen to gallium is 1.08.

The electrophotographic characteristics of the photoreceptor are evaluated in the same manner as Example 1; only blurred images are produced in the evaluation of image characteristics. The photoreceptor cannot hold an electrostatic latent image, so that potential and image characteristics cannot be evaluated.

The results are summarized in Table 1.

Comparative Example 2

An electrophotographic photoreceptor having a surface layer is made in the same manner as Example 1, except that 200 sccm of hydrogen gas, 10 sccm of He-diluted oxygen (4%), and 50 sccm of nitrogen gas, and 5 sccm of hydrogen-diluted trimethylgallium (about 10%) are supplied to the vacuum chamber during the formation of the surface layer, and the film formation time is changed to 60 minutes.

The section of the photoreceptor is observed by SEM in the same manner as Example 1, and it is found that the thickness is 0.32 μm. The elemental composition is analyzed in the same manner as Example 1, and it is found that the elemental composition of gallium, oxygen, and hydrogen are 33 atom %, 41 atom %, and 20 atom % (total composition ratio of the three elements: 0.94), respectively, and the abundance ratio of oxygen to gallium is 1.24.

The electrophotographic characteristics of the photoreceptor are evaluated in the same manner as Example 1. The results are summarized in Table 1.

Comparative Example 3

An electrophotographic photoreceptor is made in the same manner as Example 1, except that the surface layer is formed as follows: a non-coated photoreceptor is introduced into a plasma CVD apparatus shown in FIG. 4, and the inside of the vacuum chamber 32 is evacuated to pressure of $1\times10^{-2}$ Pa. Subsequently, 500 sccm of hydrogen gas and 500 sccm of nitrogen gas are supplied to the vacuum chamber 32 through the gas feeding pipe under control by the mass flow controller 36. Simultaneously, the pressure in the vacuum chamber 32 is adjusted to 40 Pa by adjusting the conductance valve, the output of a radio wave of 13.56 MHz is set to 100 W by the high frequency electric source 58 and the matching box 56, and matching is accomplished by the tuner. Subsequently electricity is discharged from the discharge electrode 54, wherein the reflection wave is 0 W.

Subsequently, hydrogen-diluted trimethylgallium gas is introduced from the gas inlet tube 64 via the shower nozzle 64A such that the amount of trimethylgallium gas is 0.3 sccm. In that state, a film is formed under rotating at 20 rpm thereby making a photoreceptor having a surface layer with a thickness of 0.32 μm. The hydrogen-diluted trimethylgallium gas is supplied by bubbling hydrogen carrier gas into trimethylgallium kept at 0° C. The color of the attached thermotape indicates that the temperature during film formation is about 35° C. The thermotape used here is a sticker for measuring temperature (commercial name: Temp Plate P/N101, produced by Wahl Co., Ltd).

The obtained photoreceptor is allowed to stand at a temperature of 25° C. and a relative humidity of 50% for 24 hours to naturally oxidize the photoreceptor.

Concurrently with the film formation on the non-coated photoreceptor surface, a film is formed on the Si substrate and the infrared ray absorption spectrum of the oxidized film is measured; peaks corresponding to Ga—H, Ga—N, and N—H bonds are detected, indicating that gallium, nitrogen, and hydrogen are contained in the surface layer.

The surface of the oxidized film formed on the Si substrate is measured by XPS (X-ray photoelectron spectroscopy), and it is found that the film is composed of 60 atom % of oxygen and 40 atom % of Ga, and contains no nitrogen. It is also found that the resolution by XPS in the depth direction is about several nanometers from the outermost surface. The result of infrared absorption spectrometry on the whole surface layer indicates that at least the outermost surface of the surface layer is rich in oxygen and poor in nitrogen, wherein the concentration of oxygen atoms in the thickness direction of the surface layer decreases toward the charge transport layer (the concentration of nitrogen atoms increases toward the charge transport layer).

The electrophotographic characteristics of the photoreceptor are evaluated in the same manner as Example 1. The results are summarized in Table 1.

TABLE 1

| | Surface layer | | | Evaluation | | |
|---|---|---|---|---|---|---|
| | Thickness (μm) | Total composition ratio of group 13 element, oxygen, and hydrogen | Abundance ratio of oxygen to group 13 element | Initial residual potential (V) | Residual potential after repeat (V) | Variation in image quality (after 10,000 sheets) |
| Example 1 | 0.31 | 1.0 | 1.22 | −27 | −30 | A |
| Example 2 | 0.29 | 1.0 | 1.37 | −38 | −64 | A |
| Example 3 | 0.30 | 1.0 | 1.43 | −50 | −94 | B (reduced density) |
| Example 4 | 0.16 | 1.0 | 1.43 | −45 | −71 | B (vertical streaks) |
| Example 5 | 0.18 | 1.0 | 1.22 | −27 | −28 | B (vertical streaks) |
| Example 6 | 2.1 | 1.0 | 1.22 | −45 | −49 | A |
| Example 7 | 0.31 | 1.0 | 1.22 | −30 | −32 | A |
| Comparative Example 1 | 0.32 | 1.0 | 1.08 | Not available | Not available | Not available |
| Comparative Example 2 | 0.32 | 0.94 | 1.24 | −54 | −144 | C (image density) |
| Comparative Example 3 | 0.32 | 1.0 (outermost surface) | 1.50 (outermost surface) | −56 | −150 | C (image density) |

As shown in Table 1, in Examples wherein the composition ratio between gallium, oxygen, and hydrogen in the surface layer is about 0.95 or more and the ratio between the oxygen and gallium is from about 1.1 to about 1.5, the increase of the residual potential is suppressed in spite of the large thickness of the surface layer. On the other hand, in Comparative Examples wherein the composition ratio between oxygen and hydrogen and/or the ratio between the oxygen and gallium in the surface layer is outside the above-described range, the increase of the residual potential cannot be suppressed with image quality kept at high level.

The invention in accordance with the first aspect of the invention provides an electrophotographic photoreceptor which prevents the generation of excessive residual potential, which usually occurs on a photoreceptor having a protective layer composed of an inorganic material, and achieves both of high durability and favorable electrical characteristics.

The invention in accordance with the second aspect of the invention imparts more sufficient electrical conductivity to the surface layer, and suppresses the increase of the residual potential regardless of the increase of the film thickness.

The invention in accordance with the third aspect of the invention provides an electrophotographic photoreceptor which maintains the mechanical strength of the surface layer, and is capable of forming an electrostatic latent image upon exposure to an appropriate amount of light.

The invention in accordance with the fourth aspect of the invention efficiently provides an electrophotographic photoreceptor which achieves both of high durability and favorable electrical characteristics.

The invention in accordance with the fifth aspect of the invention efficiently provides an electrophotographic photoreceptor which achieves both of high durability and favorable electrical characteristics.

The invention in accordance with the sixth aspect of the invention facilitates handling of an electrophotographic photoreceptor which prevents the generation of excessive residual potential and achieves both of high durability and favorable electrical characteristics, and improves the adaptability of the photoreceptor to image forming apparatus having various structures.

The invention in accordance with the seventh aspect of the invention stably provides high quality images over a long period without image density unevenness or image density deterioration The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if such individual publication, patent application, or technical standard was specifically and individually indicated to be incorporated by reference.

What is claimed is:

1. An electrophotographic photoreceptor comprising a conductive substrate having thereon a photosensitive layer and a surface layer formed in this order, wherein the total composition ratio of a group 13 element, oxygen, and hydrogen to the total element content in the surface layer is about 0.95 or more, and the abundance ratio of the oxygen to the group 13 element is from about 1.1 to about 1.5.

2. The electrophotographic photoreceptor of claim 1, wherein the abundance ratio of the oxygen to the group 13 element is from about 1.1 to about 1.4.

3. The electrophotographic photoreceptor of claim 1, wherein the surface layer has a film thickness of from about 0.2 μm to about 2.0 μm.

4. The electrophotographic photoreceptor of claim 3, wherein the surface layer is formed by plasma CVD.

5. The electrophotographic photoreceptor of claim 3, wherein the photosensitive layer is an organic photosensitive layer.

6. The electrophotographic photoreceptor of claim 1, wherein the surface layer is formed by plasma CVD.

7. The electrophotographic photoreceptor of claim 6, wherein the photosensitive layer is an organic photosensitive layer.

8. The electrophotographic photoreceptor of claim 1, wherein the photosensitive layer is an organic photosensitive layer.

9. A process cartridge comprising an electrophotographic photoreceptor, and at least one member selected from the group consisting of a charging unit for charging the surface of the electrophotographic photoreceptor, a developing unit for developing the electrostatic latent image formed on the surface of the electrophotographic photoreceptor with at least a developer containing a toner thereby forming a toner image, and a transferring unit for transferring the toner image to a recording medium, wherein the electrophotographic photoreceptor is the electrophotographic photoreceptor of claim 1, and the electrophotographic photoreceptor is removable from the main body of the image forming apparatus.

10. The process cartridge of claim 9, wherein the surface layer of the electrophotographic photoreceptor has a film thickness of from about 0.2 μm to about 2.0 μm.

11. The process cartridge of claim 9, wherein the surface layer of the electrophotographic photoreceptor is formed by plasma CVD.

12. An image forming apparatus comprising an electrophotographic photoreceptor, a charging unit for charging the surface of the electrophotographic photoreceptor, an exposure unit for exposing the surface of the electrophotographic photoreceptor charged by the charging unit thereby forming an electrostatic latent image, a developing unit for developing the electrostatic latent image with a developer containing at least a toner thereby forming a toner image, and a transferring unit for transferring the toner image to a recording medium, wherein the electrophotographic photoreceptor is the electrophotographic photoreceptor of claim 1.

13. The image forming apparatus of claim 12, wherein the surface layer of the electrophotographic photoreceptor has a film thickness of from about 0.2 μm to about 2.0 μm.

14. The image forming apparatus of claim 12, wherein the surface layer of the electrophotographic photoreceptor is formed by plasma CVD.

* * * * *